US011576471B2

(12) United States Patent
Slowinski

(10) Patent No.: US 11,576,471 B2
(45) Date of Patent: Feb. 14, 2023

(54) DIAMOND CUTS PROVIDING INCREASED LIGHT AMPLIFICATION

(71) Applicant: ECNA, LLC, Great Neck, NY (US)

(72) Inventor: Christopher Slowinski, New York, NY (US)

(73) Assignee: ECNA, LLC, Great Neck, NY (US)

( * ) Notice: Subject to any disclaimer, the term of this patent is extended or adjusted under 35 U.S.C. 154(b) by 52 days.

(21) Appl. No.: 17/168,063

(22) Filed: Feb. 4, 2021

(65) Prior Publication Data

US 2021/0244140 A1 Aug. 12, 2021

Related U.S. Application Data

(60) Provisional application No. 62/971,806, filed on Feb. 7, 2020.

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/001; A44C 17/007; A44C 17/008
USPC ..... D11/90; 63/32
See application file for complete search history.

(56) References Cited

U.S. PATENT DOCUMENTS

| | | | | |
|---|---|---|---|---|
| 5,186,024 | A * | 2/1993 | Waters, Jr. | A44C 17/001 63/32 |
| 6,474,102 | B1 * | 11/2002 | Buerger | A44C 17/001 63/32 |
| D698,278 | S | 1/2014 | Slowinkski | |
| 9,398,791 | B1 | 7/2016 | Slowinski | |
| 10,448,713 | B1 * | 10/2019 | Gavin | A44C 17/001 |
| 2013/0319045 | A1 * | 12/2013 | Ritchie | A44C 17/001 63/32 |

FOREIGN PATENT DOCUMENTS

| | | | | |
|---|---|---|---|---|
| CN | 107440267 | A * | 12/2017 | |
| DE | 9404602 | U1 * | 3/1994 | |
| WO | WO-2010094089 | A2 * | 8/2010 | A44C 17/001 |

OTHER PUBLICATIONS https://www.americangemsociety.org/ags-laboratories/jewelry-industry/supported-diamond-shapes/ 1998 (Year: 1998).*

* cited by examiner

*Primary Examiner* — Jack W Lavinder
(74) *Attorney, Agent, or Firm* — Ostrolenk Faber LLP

(57) ABSTRACT

A sparkling, oblong-shaped precious stone, such as an emerald or cushion cut diamond is formed by a planar table facet, a girdle, two pairs of long crown facets located between the table facet and the girdle, and the two pairs of long pavilion facets located between the base of the stone and the girdle.

9 Claims, 4 Drawing Sheets

DIAMOND CUTS PROVIDING INCREASED LIGHT AMPLIFICATION

CROSS-REFERENCE TO RELATED APPLICATION

The present non-provisional patent application claims the benefit of and priority to U.S. Provisional Patent Application No. 62/971,806, filed Feb. 7, 2020, by Christopher Slowinski, and entitled "DIAMOND CUTS PROVIDING INCREASED LIGHT AMPLIFICATION," the entire contents of which are incorporated herein by reference.

FIELD OF THE INVENTION

The present invention is generally directed to gemstones and, more particularly, to non-round gemstones, preferably diamonds, having a unique cut that produce greater light amplification at the crown and table facets thereof.

BACKGROUND

The original round, brilliant-cut was developed by Marcel Tolkowsky in 1919. The round brilliant consists of 58 facets and is widely popular. In more recent years, non-round (oblong) diamond shapes have come into vogue. The present invention is focused on non-round diamond cuts, such as those that are known as the emerald, cushion and radiant cuts. But the disclosure herein is also applicable to other oblong shapes, such as the marquis and oval cuts. It may even be applied to the asscher cuts as well. The unique look of the emerald cut diamonds is created by the "step cuts" of its pavilion and its large, open table. Instead of the sparkle of the brilliant cut, emerald cut diamonds produce a hall-of-reflection-mirrors effect, with an interplay of light and dark planes. While less fiery, the long lines and dramatic flashes of light give the emerald cut an elegant appeal.

The present invention builds and improves upon the specially-shaped emerald diamond shown in the present inventor's issued U.S. Design Pat. No. D698,278, the contents of which are incorporated herein by reference. The present disclosure also constitutes a startling improvement over the design shown in the present inventor's U.S. Pat. No. 9,398,791, the contents of which are incorporated by reference herein. Some of the background information is repeated herein from U.S. Pat. No. 9,398,791.

As is well known, emerald and cushion cut diamonds have associated therewith certain parameters. These parameters include the crown angle, the crown height percentage, the girdle height percentage, the pavilion angle, the table percentage and the total depth percentage. Conventionally, the crown angle for an emerald cut is in the range of 35-36°. The pavilion angle is in the range of 40-41.5°. The total depth percentage is conventionally in the range of 60-70%.

As could be appreciated from the foregoing, emerald cut diamonds do not provide the brilliance and light reflecting experience which is the hallmark of the round, brilliant cut stones. The diamond trade has invested enormous efforts in searching for and attempting to find cuts that would increase the brilliance of oblong gemstones such as the emerald and cushion cut stones.

SUMMARY OF THE INVENTION

It is an object of the present invention to provide oblong gemstone shapes that are more sparkling.

It is another object of the invention to provide oblong shaped gemstones, particularly diamonds, that provide greater light reflection amplification.

It is a further object of the invention to provide diamonds that produce greater light amplification, but which achieve that aspect with fewer facets as compared to the diamonds shown in the incorporated by reference patents.

The foregoing and other objects of the invention are realized by an oblong precious stone that includes: a table having a table plane; first two long crown facets extending at respective predetermined crown angles to the table plane; second long crown facets opposed to the first long crown facets and extending at said respective crown angles relative to the table plane; a first pair of long pavilion facets extending at predetermined respective pavilion angles relative to the table plane; a second pair of long pavilion facets extending oppositely to the first long pavilion facets and extending at said predetermined respective pavilion angle relative to the table plane.

The improved light amplification is enhanced by the unconventional girdle which has, as indicated on the drawing sheet, an angle height percentage range of 2.5 to 5.0 percent of the overall stone height.

Other features and advantages of the present invention will become apparent from the following description of the invention which refers to the accompanying drawings.

DETAILED DESCRIPTION OF PREFERRED EMBODIMENTS OF THE INVENTION

Figure 1:
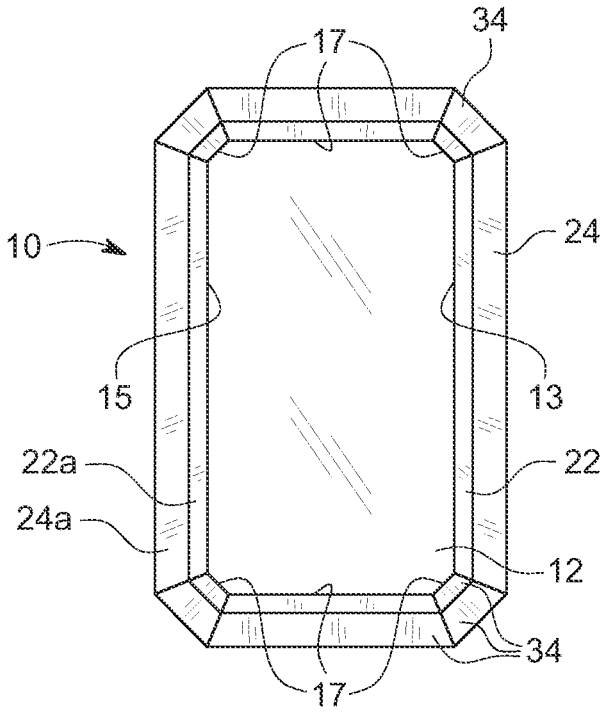
FIG. 1 is a top view of an emerald stone in accordance with the present invention.

Referring to FIGS. 1-6, FIG. 5 is a perspective of the new precious emerald cut stone which has a unique arrangements of crown and pavilion facets as well as an accompanying girdle facet, which together achieve a unique and amplified light pattern in accordance with the present invention. Most importantly are the angles at which the crown and pavilion facets are inclined relative to the table facet. Thus, for example, a first (upper) crown facet 22 has an angle of inclination of 28° to 33°; the second (lower) crown facet 24 has an angle in the range of 35° to 41°; the first (upper) pavilion facet 28 extends at an angle of 31° to 36°; and the second (lower) pavilion facet 32 extends at an angle of 29° to 34°.

Referring to FIG. 1-5, an oblong precious stone 10 according to the present invention is a stone body having a table facet 12 defined by a flat surface. The table facet 12 includes a first long side 13, a second long side 15 opposite the first long side 13, and shorter sides 17 between the first long side 13 and the second long side 15. The stone body includes a base 14 opposite the table 12. The distance between the table facet 12 and the base 14 defines the height for the stone body.

The stone body further includes a crown having two elongated upper crown facets 22, 22*a* each oriented at an angle relative to the table facet 12 in the range 28°-33° and two elongated lower crown facets 24, 24*a* each oriented relative to the table facet 12 in the range 35°-41°. One of the two elongated upper crown facets 22 is located at and extends along the first long side 13 of the table facet 12, and the other one of the two elongated upper crown facets 22*a* is located at and extends along the second long side 15 of the table facet 12. One of the two elongated lower crown facets 24 is located at and extends along one of the two elongated upper crown facets 22, and the other one of the two elongated lower crown facets 24*a* is located at and extends along the other one the two elongated upper crown facets 22*a*.

The stone body further includes a girdle 26 located at the crown, and a pavilion located at the girdle 26.

The pavilion has two elongated upper pavilion facets 28, 28*a* each oriented at an angle relative to the table facet 12 in the range 31°-36° and two elongated lower pavilion facets 32, 32*a* each oriented at an angle relative to the table facet 12 in the range 29°-34°. One of the two elongated upper pavilion facets 28 is located at and extends along a side 19 of the girdle 26, the other one of the two elongated upper pavilion facets 28*a* is located at and extends along an opposite side 21 of the girdle 26. One of the two elongated lower pavilion facets 32 is located at and extends along one of the two elongated upper pavilion facets 28, and the other one of the two elongated lower pavilion facets 32*a* is located at and extends along the other one the two elongated upper pavilion facets 28*a*. The two elongated lower pavilion facets 32, 32*a* meeting at a culet line located at the base 14 of the stone body.

Figure 5:
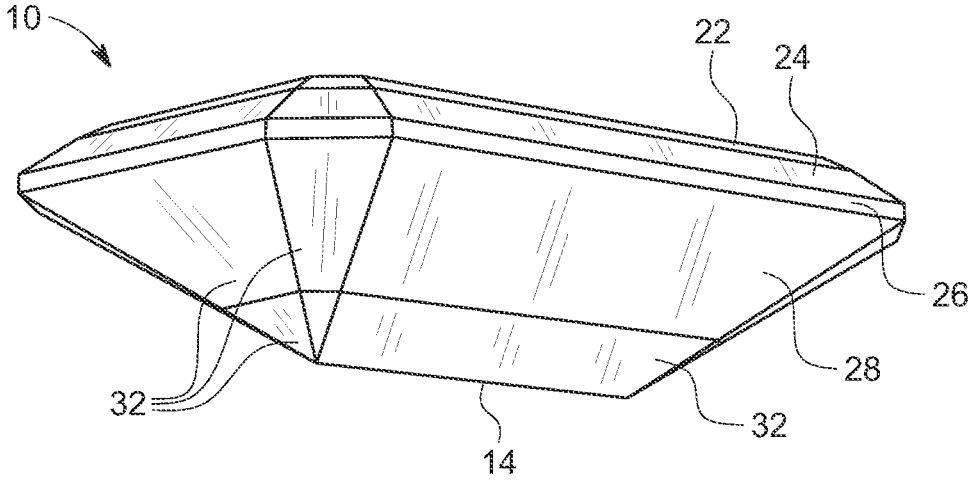
FIG. 5 is a perspective of the emerald stone in accordance of the present invention.
Figure 6:
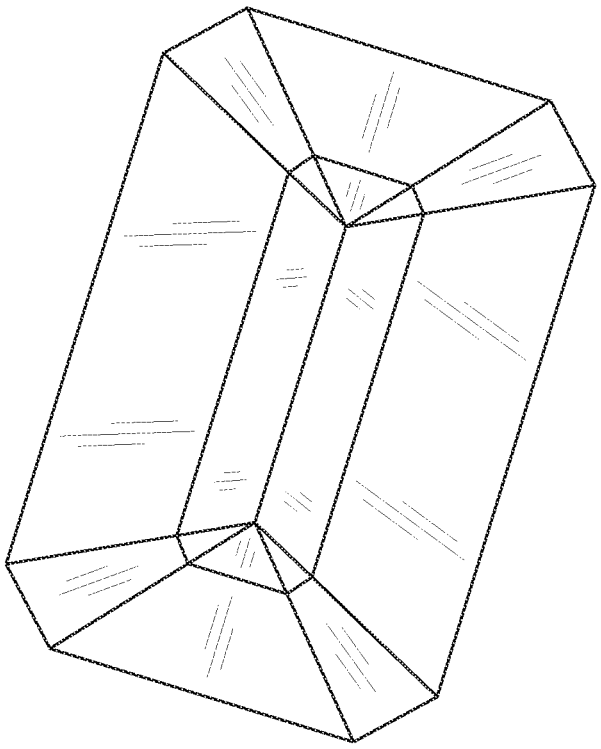
FIG. 6 is a photograph of an emerald cut stone in accordance with the present invention.

With reference to FIG. 1 and the perspective view of FIG. 5, it will be seen that the table facet 12 is flanked by an elongated upper crown facet 22 and an elongated lower crown facet 24 along its two opposing, long sides (where the juxtaposed crown facets are indicated by reference numerals 22*a* and 24*a*). The crown facets which are seen from the end views are referred to here as the miscellaneous facets 34 and are not the focus of the present invention.

Figure 2:
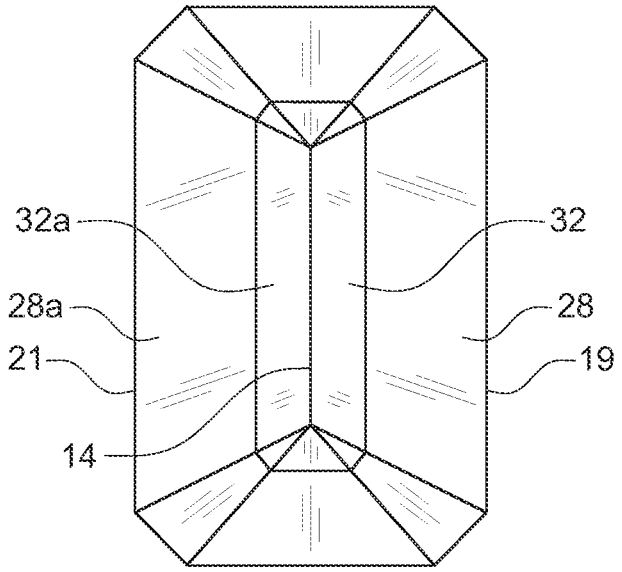
FIG. 2 is a bottom view of an emerald stone in accordance with the present invention.
Figure 3:
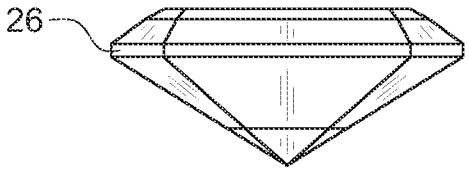
FIG. 3 is an end view of an emerald stone in accordance with the present invention.
Figure 4:
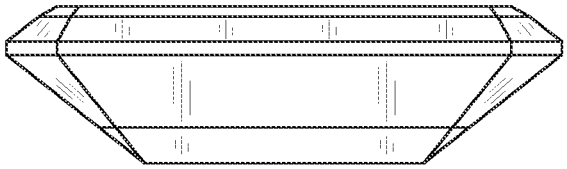
FIG. 4 is a side view of an emerald stone in accordance with the present invention.

With reference to FIG. 2, which is a bottom view, and the perspective view in FIG. 5, one can see an elongated upper pavilion facet 28 which extends at a first pavilion angle and an elongated pavilion facet 32 which reaches all the way to the culet line at the base 14. The juxtaposed pavilion facets are indicated by reference numerals 28*a*, and 32*a*.

The crown and pavilion facets are separated by the girdle facet 26 which has, as indicated in the figures, a girdle height percentage from 2.5% to 5.0%.

The present inventor has surprisingly discovered that this very specific arrangement of the crown and pavilion facets, as well as the size of the girdle, results in an image that, when viewed from the table side of the stone, shows the culet surrounded by additional light reflection bands that are actually reflected from the girdle, which is very surprising and unheard of in the art of diamond cutting, to the inventor's present knowledge. Regardless, and as seen in the photographically rendered FIG. 6, the overall look and appearance of the emerald cut stone is that it mimics and reproduces the brilliance of a conventional emerald stone at a a small fraction of the price, owing to the much lower caratage of the stone that is produced by the cutting method of the present invention.

A precious stone according to the present invention may be a diamond.

A precious stone according to the present invention may have a cushion-cut shape, an emerald-cut shape, a radiant shape, an oval shape, a marquis shape, or a princess shape.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An oblong precious stone comprising:

a stone body, the stone body having, a table facet defined by a flat surface, the table facet including a first long side, a second long side opposite the first long side, and shorter sides between the first long side and the second long side, a base opposite the table, a distance between the table facet and the base defining a height for the stone body, a crown having two elongated upper crown facets each oriented at an angle relative to the table facet in the range 28°-33° and two elongated lower crown facets each oriented relative to the table facet in the range 35°-41°, one of the two elongated upper crown facets located at and extending along the first long side of the table facet, the other one of the two elongated upper crown facets being located at and extending along the second long side of the table facet, one of the two elongated lower crown facets being located at and extending along one of the two elongated upper crown facets, and the other one of the two elongated lower crown facets being located at and extending along the other one the two elongated upper crown facets, a girdle at the crown, and a pavilion at the girdle, the pavilion having two elongated upper pavilion facets each oriented at an angle relative to the table facet in the range 31°-36° and two elongated lower pavilion facets each oriented at an angle relative to the table facet in the range 29°-34°, one of the two elongated upper pavilion facets located at and extending along a side of the girdle, the other one of the two elongated upper pavilion facets being located at and extending along an opposite side of the girdle, one of the two elongated lower pavilion facets being located at and extending along one of the two elongated upper pavilion facets, the other one of the two elongated lower pavilion facets being located at and extending along the other one the two elongated upper pavilion facets, and the two elongated lower pavilion facets meeting at a culet line located at the base of the stone body.

2. The precious stone of claim 1, wherein the girdle spans 2.5% to 5% of the height of the stone body.

3. The precious stone of claim 1, wherein said precious stone is a diamond.

4. The precious stone of claim 1, wherein said precious stone has a cushion-cut shape.

5. The precious stone of claim 1, wherein said precious stone has an emerald-cut shape.

6. The precious stone of claim 1, wherein said precious stone has a radiant shape.

7. The precious stone of claim 1, wherein said precious stone has an oval shape.

8. The precious stone of claim 1, wherein said precious stone has a marquis shape.

9. The precious stone of claim 1, wherein said precious stone has a princess shape.

* * * * *